United States Patent [19]

Schachenmann

[11] Patent Number: 4,566,497

[45] Date of Patent: Jan. 28, 1986

[54] AIR DISCHARGE DEVICE FOR A WEAVING MACHINE

[75] Inventor: Andreas Schachenmann, Schaffhausen, Switzerland

[73] Assignee: Sulzer Brothers Limited, Winterthur, Switzerland

[21] Appl. No.: 655,211

[22] Filed: Sep. 27, 1984

[30] Foreign Application Priority Data

Oct. 11, 1983 [EP] European Pat. Off. ..... 83110111.8

[51] Int. Cl.[4] ..... D03J 1/04

[52] U.S. Cl. ..... 139/1 C

[58] Field of Search ..... 139/1 C; 15/345; 134/37; 68/5 R, 5 A, 435

[56] References Cited

U.S. PATENT DOCUMENTS

| | | | |
|---|---|---|---|
| 2,400,792 | 5/1946 | Turner | 139/1 C |
| 3,491,801 | 1/1970 | Lippuner | 139/1 C |
| 4,230,158 | 10/1980 | Hintsch | 139/1 C |
| 4,487,236 | 12/1984 | Gunneman | 139/435 |

FOREIGN PATENT DOCUMENTS

| | | | |
|---|---|---|---|
| 494463 | 3/1976 | U.S.S.R. | 139/1 C |

*Primary Examiner*—Henry S. Jaudon

*Attorney, Agent, or Firm*—Kenyon and Kenyon

[57] ABSTRACT

The air discharge device is constructed with a continuously rotating body to cause periodic unilateral deflections of the discharge stream of air. An "air broom" effect is created which serves to clean the work stations of a weaving machines. Fiber material can be removed from the weaving machine by the air discharge device without requiring any special control of the air feed.

10 Claims, 5 Drawing Figures

AIR DISCHARGE DEVICE FOR A WEAVING MACHINE

This invention relates to an air discharge device for a weaving machine. More particularly, this invention relates to an air discharge device for a work station in a weaving machine.

As is known, in yarn processing, more or less detritus or fly is produced, depending on the type of yarn which is being processed. Further, this problem appears to an especially high degree at points where a yarn undergoes attritional stress, for example, a change of direction. One problem in this respect occurs in weaving machines particularly in the yarn feeding and weft insertion area. In fact, if an accumulation of fuzz, fly, lint or the like in this area is not prevented, these materials will pass into the shed together with the weft and will cause soiling of the fabric which is being produced. This can become especially serious if the fly had been fouled by lubricating oil in a picking mechanism before being taken along by the weft. As is known, fly which is introduced into a fabric reduces the quality of the fabric to an undesirable degree.

In the past, various types of devices have been known for cleaning or blowinq out the work stations in a weavinq machine in order to maintain the work stations free of fly and the like. In some cases, the devices have been constructed as blow-off and/or suction devices which are either installed in a fixed manner or which travel back and forth over the weaving machines of a plant room. In many cases, these devices employ air jets which sweep across the weaving machines, for example cross wise to the direction of the direction of travel of a weft. In these cases, the movement of the air jets has been produced by pivoting nozzles.

For example, German P.S. No. 1535894, German O.S. No. 1919229 and U.S. Pat. No. 2,798,825 describe devices which employ pivoting nozzles and which devices travel over the weaving machines of a plant room. However, such devices or installations are relatively expensive. Furthermore, because of the oscillation of the pivoting nozzles, it has not been possible to remove fly from a weaving machine in one direction only. This, however, is necessary, for example, in the weft insertion area of a weaving machine where the fly must be transported out of the picking mechanism counter to the weft direction.

German A.S. No. 2712983 describes a structure which employs fixed blowing devices. However, these fixed blowing devices blow off only a narrowly limited region of the machine and the fly blown out of this region is not completely removed from the machine. Other devices which are fixedly mounted are also known from Japanese Utility Model No. 4305/80 wherein a blowing nozzle is positioned above a picking mechanism while a suction nozzle is positioned below the picking mechanism. With this construction, the fly or lint seized by the air jets is picked up only in the "jet zone" of the blowing nozzle and is blown away to all sides. Hence, at least part of the fly is blown in the direction of the weft travel.

Accordingly, it is an object of the invention to provide a device of simple construction for removing fiber fly from the work stations of a weaving meaching counter to the direction of thread travel.

It is another object of the invention to provide a relatively simple and inexpensive construction for removing fly from a weft delivered to a shed of a weaving machine.

It is another object of the invention to be able to readily clean various work stations of a weaving machine in a simple, inexpensive manner.

Briefly, the invention provides an air discharge device for a work station in a weaving machine wherein the device comprises a housing which defines a chamber for receiving a flow of compressed air and which has a slot communicating with the chamber to discharge a stream of air as well as a rotatable body for periodically diverting the stream of air discharged from the slot to create periodic unilateral deflections of the stream of air.

The periodic unilateral deflections of the stream of air which is in the form of an air jet "sweep" the fiber fly like a broom away to one side. In contrast to air discharge devices which employ stationary air jets, no dead spaces for fly accumulation can form because of this sweeping action. In contrast to pivoting nozzles, the fly is transported away in a defined direction without requiring a special control of the air feed.

The rotatable body may be continuously rotatable. In this respect, a drive for a continuously rotating body is simpler than a pivoting mechanism.

In one particularly simple and operationally safe construction, the rotatable body is disposed adjacent to an exit end of the slot to rotate on an axis offset from the exit end in order to produce a Coanda effect. Further, the air stream may be directed rigidly against the work station to be cleaned. In this case, the air discharge device need contain no moving parts except for the rotatable body.

Further, the rotatable body may be formed of a pair of circular-cylindrical sectors which are disposed in offset relation along a common diametric plane in order to define a pair of circumferentially spaced steps. Alternatively, the circular-cylindrical sectors may be made of equal radii while being displaced relative to each other along a diameter to form two or four steps on the circumference of the stepped body.

In another embodiment, the housing of the air discharge device may be made as a hollow cylinder having a slot while the rotatable body is in the form of a hollow sleeve rotatably mounted in coaxial slidable relation with the cylinder. In this case, the sleeve is provided with at least one slot for periodic alignment with the slot in the cylinder in order to permit discharge of a stream of air. In this case, the hollow cylinder may be fixed with the slot in the cylinder directed over a predetermined angle towards a work station of a weaving machine. In this embodiment, the hollow rotatable sleeve may be mounted on the outside of the hollow cylinder of the housing or within the hollow cylinder of the housing.

The drive of the rotatable body may be effected either by a motor or by the air to be deflected. In the latter case, the rotatable body is freely mounted so as to rotate on a longitudinal axis under the force of the stream of air impinging thereon. In order to limit the number of deflections, the rotational speed of the rotatable body can be controlled by an adjustable friction brake, for example to provide a deflection frequency of one to sixty deflections per minute, and preferrably up to thirty deflections per minute.

In order to clean the weft insertion area of a weaving machine, the air discharge device may be installed in a whole system of cleaning nozzles. In this case, the air discharge device may expediently be arranged in the region of a thread tensioner and a thread brake or may be displaced out of this region in the direction of a thread transfer zone.

The overall cleaning system may be completed by the use of a nozzle such as a slot nozzle, for directing a vertical curtain between a picking mechanism and a thread shear downstream of the tensioner relative to a thread passing through the brake and the tensioner. In this case, the vertical air curtain is disposed to extend crosswise to the weft direction. Further, it is advantageous if a cover plate is disposed between this nozzle and the shear in order to limit the air curtain from the shear and a slay.

Still further, the cleaning system may be provided with a further nozzle for directing a flow of air obliquely down onto the picking mechanism and in a direction opposite to the direction of travel of the thread. This nozzle can be provided between the air discharge device and the nozzle for creating the air curtain between the picking mechanism and shear.

These and other objects and advantages of the invention will become more apparent from the following detailed description taking in conjunction with the accompanying drawings wherein.

Figure 1:
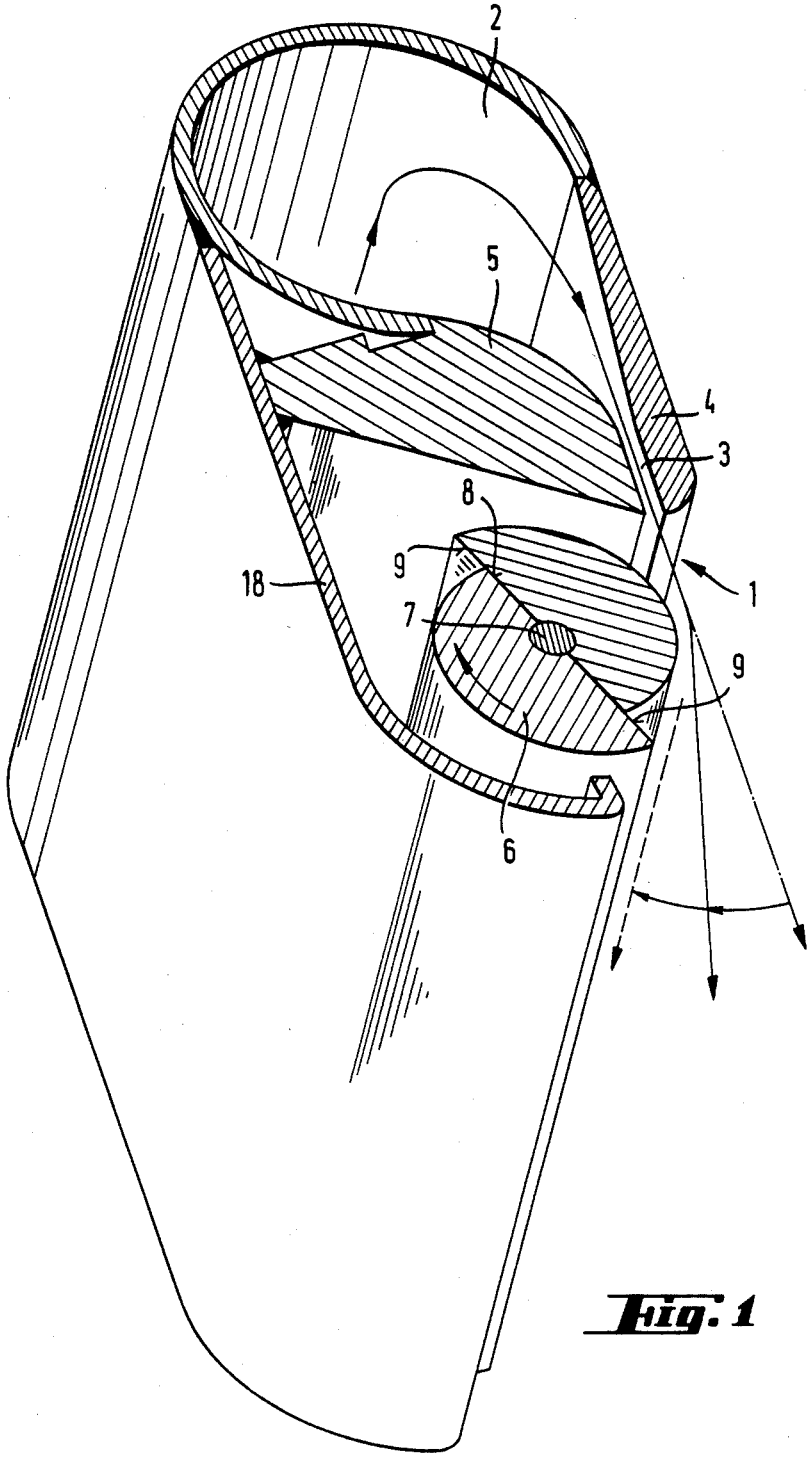
FIG. 1 illustrates a schematic perspective view of an air discharge device constructed in accordance with the invention.

Referring to FIG. 1, the air discharge device 1 is provided with a housing which defines a chamber 2 for receiving a flow of compressed air from a compressed air line (not shown). In this regard, the housing is closed at the free end by a back wall (not shown). In addition, the housing has a tangential air discharge slot 3 communicating with the chamber 2 and narrowing therefrom in funnel form in order to discharge a stream of air as indicated. As shown, the slot 3 is defined by a side wall 4 of the housing and by a shaped body 5 disposed within the housing.

In addition, the air discharge device includes a rotatable body 6 for periodically diverting the stream of air discharged from the slot 3 in order to create periodic unilateral deflections of the stream of air as indicated by the arrows. This rotatable body is mounted to rotate via an axle 7 on a longitudinal axis while being driven, for example by an electric motor (not shown). As indicated, the rotatable body 6 is formed of pair of circular-cylindrical sectors which are disposed in offset relation along a common diametric plane 8 to define a pair of circumferentially spaced steps 9. In addition, the rotatable body 6 is disposed adjacent to the exit end of the slot 3 with the axle 7 offset laterally to the exit end of the slot so that the curved surfaces of the body 6 protrude into the air stream issuing from a slot 3 to deflect the stream unilaterally in the direction of the body 6.

The steps 9 of the body 6 which are created by the cylinder halves cause the flow of air along the curved surface to break off after one half revolution of the body 6 so that the deflection of the air jet ceases and the air flow "jumps back" into the discharge slot 3. With the body 6 unilaterally embraced partially by a wall 18 of the housing opposite the wall 4, periodic unilateral deflections of the air stream can occur if the body 6 rotates in a uniform and continuous manner. The periodic deflections in turn create an air jet which "sweeps" in the manner of an "air broom".

Of note, the positioning of the rotatable body 6 in offset relation to the slot 3 produces a Coanda effect.

Figure 5:
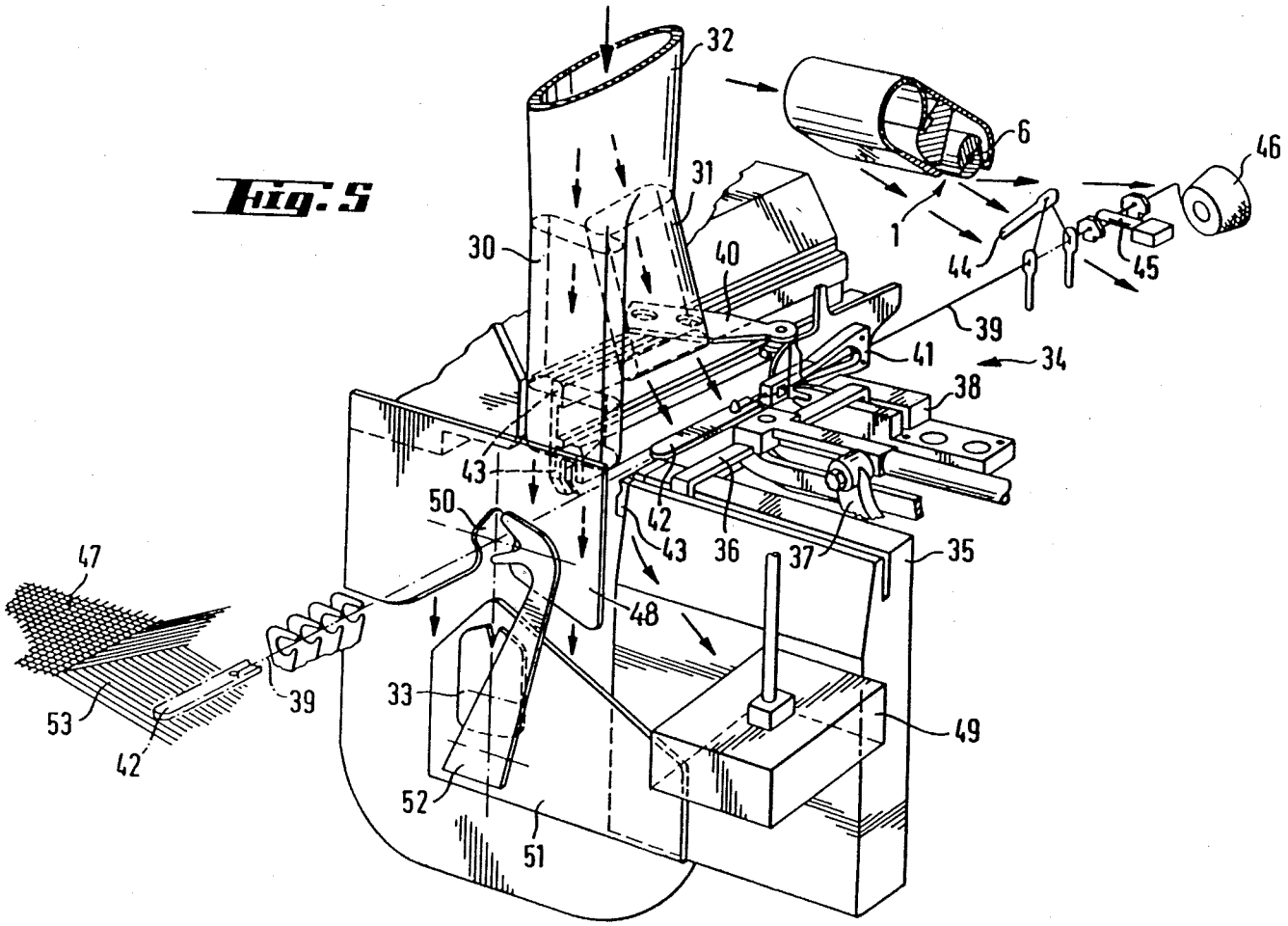
FIG. 5 illustrates a schematic view of a weft feeding end of a weaving machine provided with an air cleaning system in accordance with the invention.

Referring to FIG. 5, the air discharge device 1 may be positioned over the work stations of a weaving machine, for example over a thread tensioner 44 and a thread brake 45 so that the periodically deflected air jet is able to sweep the work stations free of lint, fly, and alike.

Figure 2:
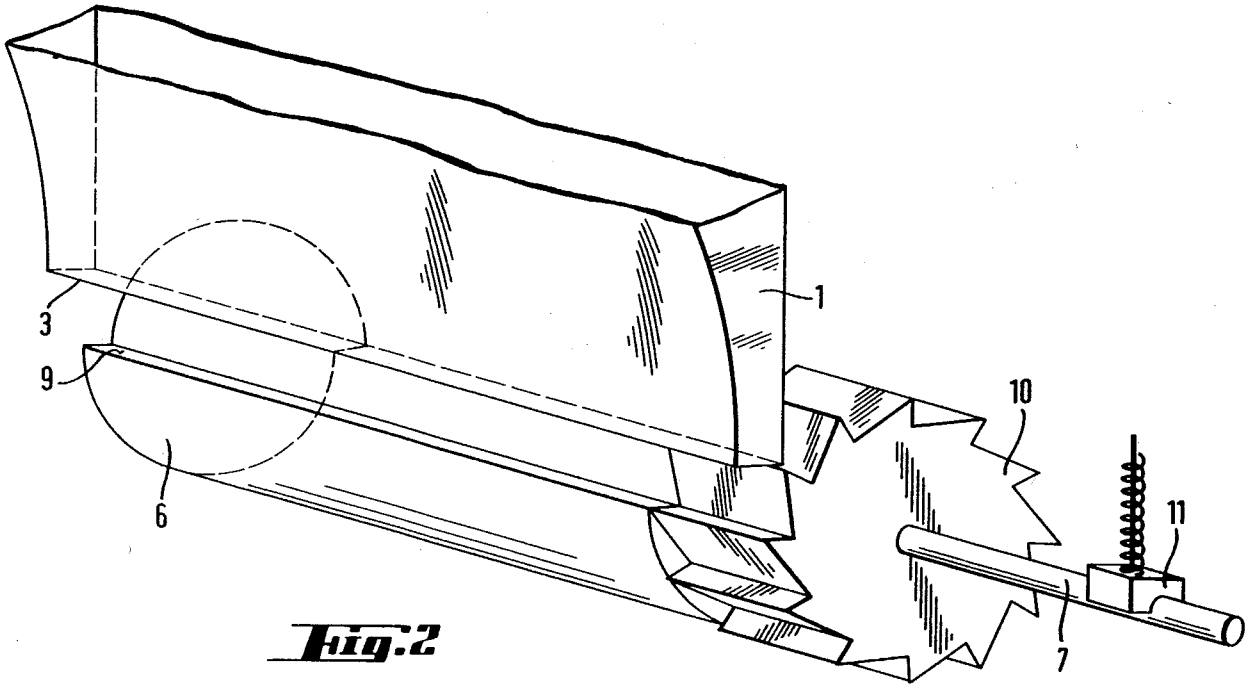
FIG. 2 illustrates a means for the free rotation of the rotatable body of FIG. 1 along with an adjustable friction brake in accordance with the invention.

Referring to FIG. 2, wherein like reference characters indicate like parts as above, the rotatable body 6 may have a part constructed as a gear type air turbine 10 which constitutes a self-drive for the body 6. If left to itself, such a self-drive would result in excessive rotational speeds of the body 6. In this respect, the speed of the body 6 should be, at most, 30 revolutions per minute for a two-step construction. Accordingly, the rotation of the body 6 is braked by means of a friction brake 11 which acts on the axle 7. Since the brake force necessary for maintaining a certain rotational speed varies during the course of operation, for example due to impurities in the fan of the "air drive" and/or the suspension of the rotatable body 6, the friction brake 11 is adjustable.

Figure 3:
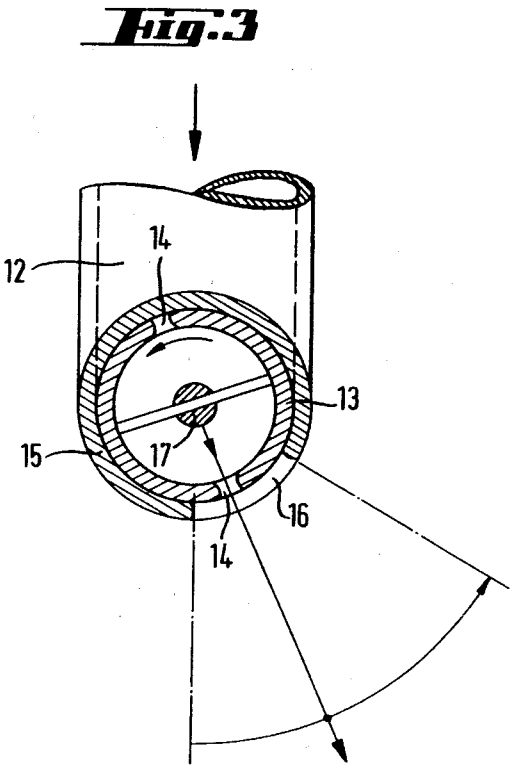
FIG. 3 illustrates a part cross-sectional view of a modified air discharge device constructed in accordance with the invention.

Referring to FIG. 3, the air discharge device may be constructed with a housing which is in the form of a hollow cylinder 15 having a slot 16 which is cut out over a predetermined angle and directed towards a work station of the weaving machined In addition, the air discharge device includes a rotatable body in the form of a hollow sleeve 13 which is rotatably mounted in coaxial slidable relation within the cylinder 15. In this case, the sleeve 13 is connected to a pressure line 12 along with the chamber defined by the cylinder 15 in order to receive a flow of compressed air. In addition, the sleeve 13 can be rotated by being driven by the air to be deflected or by an electric motor by way of a shaft 17. As shown, the sleeve 13 is also provided with a pair of diametrically opposite slots 14 which are brought into periodic alignment with the slot 16 in the cylinder 15 during rotation of the sleeve 13 in order to permit periodic discharges of streams of air. Thus, during rotation of the sleeve, a periodic unilateral deflection of the air jet can be brought about to provide an "air broom" effect.

Figure 4:
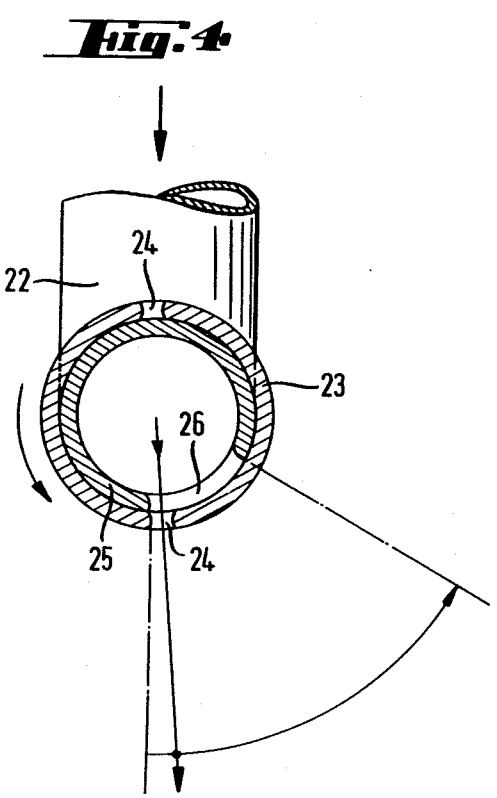
FIG. 4 illustrates a view similar to FIG. 3 of a further modified air discharge device employing a rotatable sleeve within a hollow cylinder housing in accordance with the invention.

Referring to FIG. 4, the air discharge device may be constructed in a reverse manner from that as indicated in FIG. 3. For example, in this case, the rotatable body is in the form of a hollow sleeve 23 which has a pair of diametrically disposed slots 24 and which is mounted on the exterior of a hollow cylinder housing 25 which closes the pressure line 22. In addition, the hollow cylinder 25 is provided with a slot 26 to provide a "sweep zone" for the "air broom".

Referring to FIG. 5, the air discharge device 1 can be incorporated into an air cleaning system for the weft picking side of a weaving machine. In this case, the air cleaning system may also include a slot nozzle 30 set crosswise to the weft direction and an air injection nozzle 31 directed obliquely against a picking mechanism 34. Both these nozzles 30,31 may be connected to an air supply (not shown) which may consist of a fan assigned to the individual weaving machine and possibly driven by the weaving machine or by a separate electrical motor. For example, the fan may draw in weaving room air. In addition, a compressed air distributing line (not shown) may also be connected to the nozzles 30, 31.

As shown, the nozzles 30, 31 are mounted at the end of a common distributing line 32 with the slot nozzle 30 arranged and directed so as to direct a vertical air curtain downwardly between a thread picking mechanism 34 and a thread shear 33.

Of note, the weft insertion zones of the weaving machine are shown only schematically and in part. Thus, FIG. 5 illustrates the front and rear lock blocks 35, 38 and a fetch-back opener 36 with a drive lever 37 in the foreground while a fetch-back lever 40, a fetch-back or thread feeder 41, a projectile 42 and guides 43 for a beating mechanism (not shown) and for the fetch-back 41 are shown behind the weft thread 39 indicated in dash-dot lines. In addition, a weft bobbin 46 is disposed upstream of the thread tensioner 44 and thread brake 45.

The nozzle 31 serves to direct a flow of air obliquely down on to the picking mechanism 34 as well as on to the guides 43 of the projectile 42 and on to the thread transfer while the air discharge 1 sweeps with a periodically deflected air jet over the tensioner 44, brake 45 and bobbin 46. The air curtain generated by the slot nozzle 30 is limited by a cover plate 47 between the nozzle 30 and the shear 33 in order to limit the air curtain from the shear and, thus, from the fabric 47 being produced. As indicated, the cover plate 48 may be opened toward the bottom.

In addition, the air curtain from the slot nozzle 30 serves to clean a projectile lubrication means 49 by blowing across this means which lies before the front lock block 35 and before a cam plate 51 in FIG. 5. The cleaning of lubrication means 49 can be improved if the cover plate 48 is partially closed on the side.

For yarns which cause relatively little fly formation, the cover plate 48 may be closed or prolonged toward the bottom so as to form a closed wall containing only a passage opening 50 for the projectile 42. Further, by closing off the bottom of the cover plate 48 the shielding of the air current toward the shed 53 is improved.

Of note, the cam plate 51—mounted on the front lock block 35—for control of the thread shear 33 and a centering vane 52 are illustrated below the cover plate 48.

The parts of the weft insertion mechanism which move in the direction of the shed 53 provide a tendency of any flying material (fluff) to move with one component in the direction of weft travel. Against this, the vertical air curtain acts as a barrier. Together with the cover plate 48, the air curtain shields the shed 53 and hence the fabric 47 from the fly produced in the picking mechanism 34. Further, the fibers which may pass into the air current are removed from the machine downwardly.

During operation of the air cleaning system, the air injection nozzle 31 and the air discharge device 1 clean the picking mechanism 34, the tensioner 44 and brake 45 where much of the fly originates through thread transfer, thread transport and thread braking. Further, the fly which is blown out by the air injection nozzle 31 into the sphere of action of the air discharge device 1 is also removed from the weaving machine by the sweeping action created by the air discharge device 1.

By installing suitable valves in the distributing line 32, intermittent flows there may be ejected through the slot nozzle 30 and the air injection nozzle 31. The resulting air impulses may then be used to support the blowing action by their shock effect with pulse frequencies of less than sixty per minute, preferrably under thirty per minute, being maintained.

By arranging a number of separate elements which blow in different directions, the entire weft insertion air can be covered with no "dead" corners forming so that fly can be reliably transported out of the region of the weft insertion area by the blast air. The speeds or energies of the "cleaning air jets" must be selected in the entire system in such a way that, on the one hand, fly material is removed as extensively as possible, but that, on the other hand, the conduction and position of the thread are not impaired by the blast air.

The invention thus provides an air dischange device of relatively simple construction for the cleaning of the work stations of a weaving machine. Further, the invention provides an air discharge device which can be incorporated in an overall air cleaning system for effectively cleaning the weft insertion area of a weaving machine.

What is claimed is:

1. An air discharge device for a work station in a weaving machine, said device comprising a housing defining a chamber for receiving a flow of compressed air and having a slot communicating with said chamber to discharge a stream of air therefrom; and a rotatable body for periodically diverting the stream of air discharged from said slot to create periodic unilateral deflections of the stream of air.

2. An air discharge device as set forth in claim 1 wherein said rotatable body is disposed adjacent to an exit end of said slot to rotate on an axis offset from said exit end to produce a Coanda effect.

3. An air discharge device as set forth in claim 2 wherein said body is formed of a pair of circular-cylindrical sectors disposed in offset relation along a common diametric plane to define a pair of circumferentially spaced steps.

4. An air discharge device as set forth in claim 1 wherein said body is freely mounted to rotate on a longitudinal axis thereof to be driven by the stream of air impinging thereon.

5. An air discharge device as set forth in claim 4 which further comprises an adjustable friction brake for braking rotation of said body.

6. An air discharge device as set forth in claim 1 wherein said housing is a hollow cylinder having said slot therein and said body is a hollow sleeve rotatably mounted in coaxial slidable relation with said cylinder, said sleeve having at least one slot therein for periodic alignment with said slot in said cylinder to permit discharge of a stream of air.

7. An air discharge device as set forth in claim 6 wherein said cylinder is fixed and said slot in said cylinder is directed over a predetermiend angle towards a work station of a weaving machine.

8. An air discharge device as set forth in claim 1 wherein said body provides a deflection frequency of 1 to 60 per minute.

9. An air discharge device for a work station in a weaving machine, said device comprising a housing defining a chamber for receiving a flow of compressed air and having a slot communicating with said chamber to discharge a stream of air therefrom; and a rotatable body parallel to said slot for periodically diverting the stream of air discharged from said slot to create periodic unilateral deflections of the stream of air for sweeping fiber fly from the work station.

10. An air discharge device as set forth in claim 9 wherein said rotatable body is disposed adjacent to an exit end of said slot to rotate on an axis offset from said exit end to produce a Coanda effect.

* * * * *